US012702901B2

(12) United States Patent
Deshmukh et al.

(10) Patent No.: US 12,702,901 B2
(45) Date of Patent: Aug. 11, 2026

(54) METHOD FOR SINGLE-STEP HEAT TREATMENT OF TITANIUM ALLOYS, GOLF CLUB STRIKING FACES, AND GOLF CLUB HEADS

(71) Applicant: Acushnet Company, Fairhaven, MA (US)

(72) Inventors: Uday V. Deshmukh, Carlsbad, CA (US); Jorgen Meister, San Marcos, CA (US)

(73) Assignee: Acushnet Company, Fairhaven, MA (US)

( * ) Notice: Subject to any disclaimer, the term of this patent is extended or adjusted under 35 U.S.C. 154(b) by 328 days.

(21) Appl. No.: 18/392,544

(22) Filed: Dec. 21, 2023

(65) Prior Publication Data

US 2025/0205560 A1 Jun. 26, 2025

(51) Int. Cl.

| | |
|---|---|
| ***A63B 53/04*** | (2015.01) |
| ***C22C 14/00*** | (2006.01) |
| ***C22F 1/02*** | (2006.01) |
| ***C22F 1/18*** | (2006.01) |

(52) U.S. Cl.

CPC ..... *A63B 53/042* (2020.08); *C22C 14/00* (2013.01); *C22F 1/02* (2013.01); *C22F 1/183* (2013.01)

(58) Field of Classification Search

CPC ..... A63B 53/042

See application file for complete search history.

(56) References Cited

U.S. PATENT DOCUMENTS

| | | | | |
|---|---|---|---|---|
| 10,207,162 | B2 | 2/2019 | Deshmukh | |
| 10,722,767 | B2 | 7/2020 | Deshmukh | |
| 2006/0287131 | A1* | 12/2006 | Hirano | A63B 53/0466 473/345 |
| 2007/0137742 | A1* | 6/2007 | Hao | C22C 14/00 420/419 |
| 2014/0295988 | A1* | 10/2014 | Sugimae | A63B 53/0466 148/669 |
| 2022/0371079 | A1* | 11/2022 | Deshmukh | A63B 53/0466 |
| 2022/0372597 | A1* | 11/2022 | Simone | C22C 27/025 |

* cited by examiner

*Primary Examiner* — Raeann Gorden

(57) ABSTRACT

A method for manufacturing a golf club head includes forming a pre-forged striking face insert from an α-β titanium alloy having a Molybdenum equivalency of about 6 to 12 or an Al equivalency of about 2 to 7, and forging the pre-forged striking face insert into a forged striking face insert having a specified geometry or curvature. In some embodiments, the method may also include performing only a single-step heat treatment on the striking face insert including heating the striking face insert to a temperature below a beta transus temperature of the α-β titanium alloy for a period of time, and thereafter cooling the striking face insert to ambient temperature. In some other embodiments, the method may further include attaching the forged striking face insert to an aft body portion to form a golf club head, and performing the single-step heat treatment and cooling on the golf club head.

20 Claims, 3 Drawing Sheets

METHOD FOR SINGLE-STEP HEAT TREATMENT OF TITANIUM ALLOYS, GOLF CLUB STRIKING FACES, AND GOLF CLUB HEADS

BACKGROUND

Conceptually, the game of golf is a simple one. Strike a ball multiple times until it lands in the hole. In practice, however, golf requires incredible skill and training, perhaps some natural talent, and, of course, the right tools. As the game of golf has existed for many centuries, its tools—golf clubs—have gone through many iterations. Innovation has centered on the geometry, mechanical engineering, and materials of the shaft and club head. However, regulations on the tolerances and specifications of golf clubs make certain improvements more difficult. As such, recent research aiming to improve golf club performance has focused on materials science.

At its basic level, a golf club includes both a shaft and a club head typically constructed of different materials, and joined together at a specified angle dictated with tight tolerances by game regulations and the type of golf club—e.g., a driver (or "wood") or an iron. And while club heads have historically been made of a variety of different materials—including different types of wood, and different metals—club heads now are most commonly made of titanium alloys. However, the golf industry has traditionally used titanium alloys developed for vastly different purposes, such as aerospace and defense applications. But the material requirements and chemical, mechanical, and physical properties required of an alloy intended for aerospace and defense differ significantly from those required or desired in a golf club head. Therefore, the game of golf would greatly benefit from the development of alloy compositions specifically tailored to the performance needs and desires of a golf club.

SUMMARY

According to embodiments of the present disclosure, a method for manufacturing a striking face insert configured for use in a golf club head includes forming a pre-forged striking face insert from an alpha-beta (α-β) titanium alloy having a Molybdenum equivalency as calculated using Equation 1 of about 6 to about 12 or an Al equivalency as calculated using Equation 2 of about 2 to about 7. The method further includes forging the pre-forged striking face insert into a forged striking face insert having a specified geometry or curvature, and performing only a single-step heat-treatment on the forged striking face insert. The single-step heat-treatment includes heating the forged striking face insert in a heating chamber to a temperature below a beta transus temperature of the α-β titanium alloy for a period of time. And the method further includes thereafter cooling the forged striking face insert to ambient temperature.

In some embodiments, the α-β titanium alloy comprises a Ti—Al—V—Mo—Fe or Ti—Al—V—Fe—Cr alloy.

According to some embodiments, forging the pre-forged striking face insert may include heat exposure of the pre-forged striking face, and deforming the pre-forged striking face insert during or after the heat exposure to form the forged striking face insert having the specified geometry or curvature. The heat exposure may include heating the pre-forged striking face to an exposure temperature below the beta transus temperature of the α-β titanium alloy. For example, in some embodiments, the heat exposure may include heating the pre-forged striking face to a temperature of about 740 C to about 780 C.

In some embodiments, the cooling includes flooding the heating chamber with an inert gas. The inert gas may include argon gas.

According to some embodiments, the single-step heat-treatment includes heating the forged striking face insert in the heating chamber to a temperature of about 780 C to about 880 C. And in some embodiments, the period of time of the single-step heat-treatment may be about 15 to about 45 minutes.

In some embodiments, the single-step heat-treatment is performed under vacuum.

According to some embodiments of the present disclosure, a method for manufacturing a golf club head includes forming a pre-forged striking face insert from an alpha-beta (α-β) titanium alloy having a Molybdenum equivalency as calculated using Equation 1 of about 6 to about 12 or an Al equivalency as calculated using Equation 2 of about 2 to about 7. The method also includes forging the pre-forged striking face insert into a forged striking face insert having a specified geometry or curvature, attaching the forged striking face insert to an aft body portion to form a golf club head, and performing only a single-step heat-treatment on the golf club head. The single-step heat-treatment includes heating the golf club head in a heating chamber to a temperature below a beta transus temperature of the α-β titanium alloy for a period of time. And the method further includes thereafter cooling the golf club head to ambient temperature.

In some embodiments, the α-β titanium alloy comprises a Ti—Al—V—Mo—Fe or Ti—Al—V—Fe—Cr alloy.

According to some embodiments, forging the pre-forged striking face insert includes heat exposure of the pre-forged striking face, and deforming the pre-forged striking face insert during or after the heat exposure to form the forged striking face insert having the specified geometry or curvature. The heat exposure may include heating the pre-forged striking face to an exposure temperature below the beta transus temperature of the α-β titanium alloy. For example, in some embodiments, the heat exposure may include heating the pre-forged striking face to a temperature of about 740 C to about 780 C.

In some embodiments, the cooling includes flooding the heating chamber with an inert gas. The inert gas may include argon gas.

According to some embodiments, the single-step heat-treatment may include heating the golf club head in the heating chamber to a temperature of about 780 C to about 880 C. In some embodiments, the period of time of the single-step heat-treatment may be about 15 to about 45 minutes.

In some embodiments, the single-step heat-treatment may be performed under vacuum.

BRIEF DESCRIPTION OF THE DRAWINGS

These and other features and advantages of embodiments of the present disclosure will be better understood by reference to the following detailed description when considered in conjunction with attached drawings, in which.

DETAILED DESCRIPTION

Figure 1:
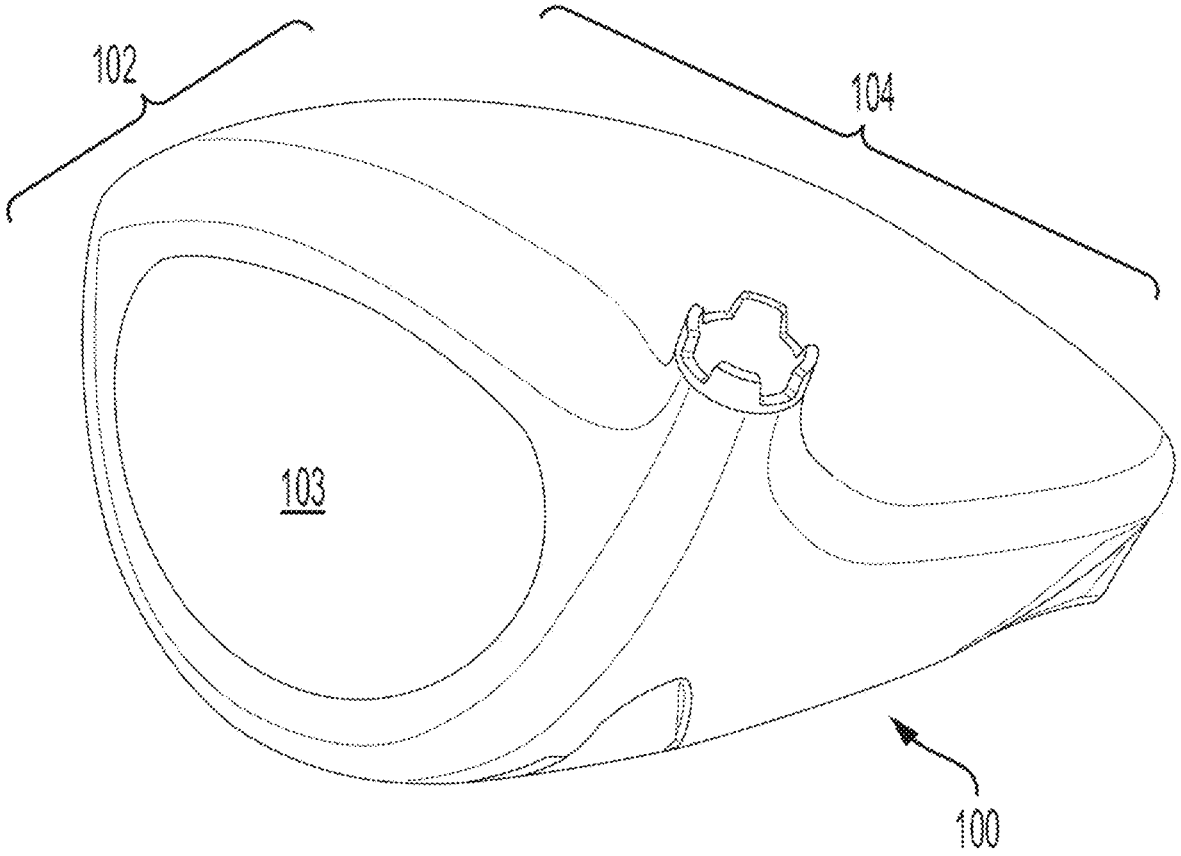
FIG. 1 is a perspective view of a golf club head according to embodiments of the present disclosure.

Pure titanium undergoes an allotropic phase transformation when heated to a "beta (β) transus" temperature of about 882° C. Specifically, below the beta (β) transus temperature, titanium has a closed packed hexagonal (CPH) lattice structure, but when heated above the beta (β) transus temperature, this changes to a body centered cubic (BCC) lattice structure. The CPH lattice structure phase is referred to as the "alpha (α) phase," and the BCC lattice structure phase is referred to as the "beta (β) phase." Titanium alloy design, therefore, can depend on which phase of titanium is desired, which, in turn, may depend on the specific application intended for the alloy. In particular, certain alloying elements can favor or stabilize the alpha (α) phase—termed "alpha (α) stabilizers"—while other alloying elements can favor or stabilize the beta (β) phase—termed "beta (β) stabilizers." Alloying titanium with alpha (α) or beta (β) stabilizers causes a change in the beta (β) transus temperature. For example, addition of alpha (α) stabilizers tends to raise the beta (β) transus temperature, resulting in a more stable alpha (α) phase, while addition of beta (β) stabilizers tends to lower the beta (β) transus temperature, resulting in a more stable beta (β) phase.

With this in mind, titanium alloys are generally classified into four main categories depending on the type of alloying elements—and consequently, on which phases are present—in the alloy. Alpha (α) alloys contain alpha (α) stabilizers and, optionally neutral elements, but no beta (β) stabilizers. Near-alpha (α) alloys also contain alpha (α) stabilizers and potentially neutral elements, but also contain small amounts of beta (β) stabilizers. Alpha (α)-plus-beta (β) alloys have both alpha (α) and beta (β) stabilizers, and optionally neutral elements. And finally, beta (β) and near-beta (β) alloys have larger amounts of beta (β) stabilizers, smaller amounts of alpha (α) stabilizers or no alpha (α) stabilizers, and may also optionally include neutral elements. Of these, alpha (α)-plus-beta (β) alloys can be made with higher strength properties than the other categories. Therefore, alpha (α)-plus-beta (β) (also termed herein, "AB" or "α-β") titanium alloys are the most commonly used alloys in applications requiring higher strength and other mechanical properties, such as in the heads or striking faces of various golf clubs.

While titanium alloys, including α-β alloys, may be used in their intended application in their as-formed state, the components formed from these alloys can sometimes benefit from heat-treatment procedures to improve certain mechanical properties. A typical heat treatment procedure for this purpose includes a two-step process. In the first step of the process, the component is heated to a temperature close to or above the beta transus temperature of the alloy for a short period of time. This step is termed "solution treatment." And in the second step of the process, the component is subsequently heated to a lower temperature for an extended period of time. This process is termed "aging." Each step of this two-step process introduces highly undesirable internal stresses in the component made from the alloy. These internal stresses can cause the component to permanently deform. For example, when applied to golf club heads, this two-step process of solution treatment followed by aging can cause changes in the overall curvature of the faces of the golf club heads.

According to embodiments of the present disclosure, a one-step, post component formation, heat treatment process involves solution treating an as-formed component formed from an α-β alloy at a predetermined temperature for a predetermined amount of time. This solution treatment is not followed by any aging procedure, and the single-step solution treated component can be used in the solution treated state (again, without any further heat treatment procedure) directly in the intended application, e.g. as a golf club head, or as a striking face of a golf club head.

Elimination of the aging step in the one-step processes according to embodiments of the present disclosure leads to various benefits and advantages. For example, as the component is no longer subjected to the aging heat treatment for an extended period of time, the one-step process according to embodiments of the present disclosure minimizes the buildup of internal stresses in the component. As a result, where the conventional two-step process would require further processing of the component after the aging step—for example, hand polishing or other mechanical manipulation to restore the component's desired geometry and dimensions—the one-step process according to embodiments of the present disclosure significantly reduces or eliminates the need for these post-treatment processes. Indeed, the one-step heat treatment process according to embodiments of the present disclosure forces the component to change its internal structure only once, and the component retains this structure upon cooling. This means that the component undergoes significantly less physical deformation. And when used on golf club heads or striking faces of golf club heads, this means that the one-step process should not cause a change in curvature of the golf club face.

As noted above, the one-step heat treatment process according to embodiments of the present disclosure includes the solution treatment of a component formed from an α-β alloy. The term "solution treatment" is used throughout this disclosure and the appended claims in its art recognized sense to refer to the heat treatment of the component such that the alpha phase of the alloy is converted to beta phase. However, as would be understood by those of ordinary skill in the art, "solution treatment" does not require full conversion of all alpha phase to beta phase. And as used herein, "solution treatment" refers to the conversion of about 70% or more of the alpha phase in the component to beta phase.

As would also be understood by those of ordinary skill in the art, the temperature and length of the one-step solution treatment needed to convert about 70% or more of the alpha phase to beta phase will vary depending on the composition of the α-β alloy used to form the component. However, in some embodiments, the one-step solution treatment may be carried out at a temperature of about 780 C to about 880 C, for example about 800 C to about 850 C, about 810 C to about 840 C, about 820 C to about 840 C, or about 830 C. And in some embodiments, the one-step solution treatment may be carried out for a period of time of about 15 minutes to about 45 minutes, for example, about 20 minutes to about 40 minutes, about 25 minutes to about 35 minutes, or about 30 minutes.

After the one-step heat treatment, the component is allowed to cool to ambient temperature before use in the intended application. This cooling may be effected in any suitable manner. For example, in some embodiments, the heat may simply be turned off, and the component allowed to cool. Alternatively, the heat may be turned off, and the chamber in which the component is place for the heat treatment may be vented to exhaust the residual heat. And in another alternative, the heat may be turned off, and the chamber in which the component is placed for the heat treatment may be flooded with a cooling gas such that the component is allowed to cool to ambient temperature under the inert atmosphere. In such embodiments, the cooling gas is not particularly limited, but should be an inert gas that does not react with or otherwise cause the oxidation of titanium. For example, in some embodiments, the cooling gas may be argon, but it is understood that the present disclosure is not limited thereto, and any suitable inert gas may be used.

As discussed above, the one-step heating process according to embodiments of the present disclosure reduce or eliminate the buildup of internal stresses in the component such that physical deformations are also reduced or eliminated. This means that the as-treated component should not require significant post-treatment mechanical processing to return the component to the desired shape or geometry. However, in some embodiments, the as-treated component may be subjected to any post-treatment physical processing necessary to provide the desired geometry, shape, or dimensions—for example, but not limited to hand polishing, etc.

And in some embodiments, the as-treated component may be further processed for purely aesthetic purposes. For example, in some embodiments, the as-treated component may be removed from the heating chamber after cooling, and aesthetically processed by any desired means—for example, laser engraving, painting, etc. And in some embodiments in which the as-treated component needs some physical processing, the as-treated component may be removed from the heating chamber after cooling, hand polished or otherwise mechanically processed to yield the desired geometry, shape or dimensions, and then subsequently aesthetically processed to impart the desired look and feel (for example, laser engraving, painting, etc.).

According to embodiments of the present disclosure, the alloys used to form the component subjected to the one-step heat treatment are not particularly limited. However, certain titanium alloys respond significantly better to the one-step solution treatment processes according to embodiments of the present disclosure. For example, while most titanium alloys may be subjected to a solution treatment step, not all titanium alloys will yield serviceable mechanical properties after solution treatment alone. Instead, most titanium alloys require the second aging step in order to yield improvements in mechanical properties. However, it has been surprisingly found that certain α-β titanium alloys having specified Molybdenum (Mo) or Aluminum (Al) equivalencies can benefit from solution treatment alone, with no need to also undergo aging in order to impart serviceable mechanical properties.

As would be understood by those of ordinary skill in the art, α-β titanium alloys include both one or more beta (β) stabilizers and one or more alpha (α) stabilizers. And these alloys can also optionally include one or more neutral elements—elements that have little or no effect or influence on the beta (β) transus temperature. However, in some embodiments, the α-β titanium alloys used to form the components do not include any neutral elements. The number, mixture, and amount of each of the beta stabilizers, alpha stabilizers, and neutral elements in the alloy is not particularly limited so long as the alloy as a whole satisfies the Mo and/or Al equivalencies, as discussed herein.

The beta (β) stabilizers in the alloys are also not particularly limited and may include any suitable beta (β) stabilizers known to those of ordinary skill in the art. Nonlimiting examples of suitable beta (β) stabilizers include V, Cr, Mn, Fe, Co, Ni, Cu, Nb, Mo, Ta, W, Hf, and Re. In some embodiments, for example, the beta (β) stabilizers may be selected from V, Cr, Mn, Fe, Co, Ni, Cu, Nb, and Mo. And in some embodiments, the beta (β) stabilizers may be selected from V, Cr, Mn, Fe, Nb, and Mo. It is understood that any combination of any number of beta (β) stabilizers may be employed in the AB (or "α-β") titanium alloys according to embodiments of the present disclosure.

The alpha (α) stabilizers are similarly not particularly limited, and may include any suitable alpha (α) stabilizers known to those of ordinary skill in the art. Nonlimiting examples of suitable alpha (α) stabilizers include Al, O, N and C. However, as the addition of Al as an alpha (α) stabilizer can improve the strength of the resulting alloy while also reducing density, in some embodiments, the AB (or "α-β") titanium alloy includes at least Al as an alpha (α) stabilizer. And in some embodiments, the AB (or "α-β") titanium alloy may include Al as the main alpha (α) stabilizer, i.e., Al is either the only alpha (α) stabilizer, or is the alpha (α) stabilizer provided in the largest nominal amount among all included alpha (α) stabilizers. However, in some embodiments, the AB (or "α-β") titanium alloy may also include O as an alpha stabilizer. As discussed above with respect to the beta (β) stabilizers, it is also understood that any combination of any number of alpha (α) stabilizers may be employed in the AB (or "α-β") titanium alloys according to embodiments of the present disclosure. By way of example only, and without any limitation, the alpha stabilizers may include at least Al and O, or may include only Al and O, or only Al.

The neutral elements are also not particularly limited, and may be any suitable neutral element that imparts little or no effect on the beta (β) transus temperature when included in the alloy. Nonlimiting examples of neutral elements include Zr, Si and Sn. For example, in some embodiments, the neutral elements may be selected from Zr and Sn. As discussed above with respect to the alpha (α) and beta (β) stabilizers, it is also understood that any combination of any number of neutral elements may be employed in the AB (or "α-β") titanium alloys according to embodiments of the present disclosure. For example, when the AB (or "α-β") titanium alloy includes 2 alpha (α) stabilizers, any combination of Zr, Si, and Sn (or other known neutral element) may be selected for the alloy composition without limitation. However, in some such embodiments including 2 neutral elements, one of the neutral elements may include Sn, and the other of the 2 neutral elements may be either Zr or Si. And in some embodiments including 1 neutral element, the neutral element may be Sn or Zr.

Nonlimiting examples of suitable AB (or "α-β") titanium alloy compositions responsive to the one-step methods according to the present disclosure include Ti—Al—V—Mo—Fe and Ti—Al—V—Fe—Cr, and variations thereof, for example, including one or more additional alpha stabilizers (e.g., O), and/or one or more neutral elements.

The nominal amounts of the various beta (β) stabilizers, alpha (α) stabilizers and neutral elements are not particularly limited, and may be any amounts suitable to achieve the specific Mo and/or Al equivalency, as discussed further herein. Throughout this disclosure, and in the claims, and unless otherwise stated, all amounts of the different alloy components—e.g., amounts of the alpha (α) and beta (β) stabilizers, neutral elements, and the titanium-refer to nominal amounts, whether the term "nominal" is used or not.

As noted above, those alloys with a specific Mo and/or Al equivalency have been found to respond particularly well to the one-step heat treatment processes according to embodiments of the present disclosure. The Mo equivalency is a measure of the beta stabilizer content of the alloy, and provides an indication of the content of the beta (β) phase in the AB (or "α-β") titanium alloy. As used herein, Mo equivalency is calculated by the following Equation 1.

Equation 1–Mo Equivalency as measure of Beta (β) Stabilizer Content $$\text{Mo } Eq. = (wt\,\%\ \text{Mo}) + 0.2\,(wt\,\%\ \text{Ta}) + 0.28(wt\,\%\ \text{Nb}) + 0.4(wt\,\%\ \text{W}) + 0.67\,(wt\,\%\ \text{V}) + 1.25(wt\,\%\ \text{Cr}) + 1.25\,(wt\,\%\ \text{Ni}) + 1.7(wt\,\%\ \text{Mn}) + 1.7(wt\,\%\ \text{Co}) + 2.9(wt\,\%\ \text{Fe})$$

In some embodiments, the Mo equivalency (as a measure of the beta (β) stabilizer content of the AB (or "α-β") titanium alloy) may be about 6 to about 12. In some embodiments, for example, the Mo equivalence may be about 7 to about 11, about 7.1 to about 11, about 7.2 to about 11, about 7.3 to about 11, about 7.4 to about 11, about 7.5 to about 11, about 7.6 to about 11, about 7.7 to about 11, about 7.8 to about 11, about 7.9 to about 11, about 7 to about 10.9, about 7 to about 10.8, about 7 to about 10.7, about 7 to about 10.6, about 7 to about 10.5, about 7 to about 10.4, about 7 to about 10.3, about 7 to about 10.2, or about 7 to about 10.1. It is also understood that these ranges also include all sub-ranges and other ranges beginning and/or ending with any point within these ranges, for example, while ranges of about 6 to about 12 and about 7 to about 11 are disclosed above, ranges of about 6 to about 11 or about 7 to about 12 are also contemplated and included within these ranges. In some embodiments, for example, the Mo equivalency may be about 6.8 to about 10, about 6 to about 10.8, about 7 to about 11.8, or about 7.2 to about 12.

The amount of each of the individual beta (β) stabilizers is not particularly limited, and may be selected based on the desired beta (β) stabilization performance, desired alloy property (e.g., strength, elongation, etc.), and contribution to the Mo equivalency. However, in some embodiments, the amount of each of the beta (β) stabilizers may individually be about 0.1 to about 4 wt %, about 0.15 to about 4 wt %, about 0.2 to about 4 wt %, about 0.25 to about 4 wt %, about 0.3 to about 4 wt %, about 0.35 to about 4 wt %, about 0.4 to about 4 wt %, about 0.45 to about 4 wt %, about 0.5 to about 4 wt %, about 0.55 to about 4 wt %, about 0.6 to about 4 wt %, about 0.65 to about 4 wt %, about 0.7 to about 4 wt %, about 0.75 to about 4 wt %, about 0.8 to about 4 wt %, about 0.85 to about 4 wt %, about 0.9 to about 4 wt %, about 0.95 to about 4 wt %, about 1 to about 4 wt %, about 1.1 to about 4 wt %, about 1.15 to about 4 wt %, about 1.2 to about 4 wt %, about 1.25 to about 4 wt %, about 1.3 to about 4 wt %, about 1.35 to about 4 wt %, about 1.4 to about 4 wt %, about 1.45 to about 4 wt %, about 1.5 to about 4 wt %, about 1.55 to about 4 wt %, about 1.6 to about 4 wt %, about 1.65 to about 4 wt %, about 1.7 to about 4 wt %, about 1.75 to about 4 wt %, about 1.8 to about 4 wt %, about 1.85 to about 4 wt %, about 1.9 to about 4 wt %, about 1.95 to about 4 wt %, about 0.1 to about 3 wt %, about 0.15 to about 3 wt %, about 0.2 to about 3 wt %, about 0.25 to about 3 wt %, about 0.3 to about 3 wt %, about 0.35 to about 3 wt %, about 0.4 to about 3 wt %, about 0.45 to about 3 wt %, about 0.5 to about 3 wt %, about 0.55 to about 3 wt %, about 0.6 to about 3 wt %, about 0.65 to about 3 wt %, about 0.7 to about 3 wt %, about 0.75 to about 3 wt %, about 0.8 to about 3 wt %, about 0.85 to about 3 wt %, about 0.9 to about 3 wt %, about 0.95 to about 3 wt %, about 1 to about 3 wt %, about 1.1 to about 3 wt %, about 1.15 to about 3 wt %, about 1.2 to about 3 wt %, about 1.25 to about 3 wt %, about 1.3 to about 3 wt %, about 1.35 to about 3 wt %, about 1.4 to about 3 wt %, or about 1.45 to about 3 wt %. It is also understood that these ranges also include all sub-ranges and other ranges beginning and/or ending with any point within these ranges, for example, while ranges of about 0.25 to about 3 wt %, about 1.75 to about 4 wt %, and about 1.25 to about 3 wt % are disclosed above, ranges of about 0.25 to about 1.25 wt %, or about 0.25 to about 1.75 wt % are also contemplated and included within these ranges.

Again as noted above, those alloys with a specific Mo and/or Al equivalency have been found to respond particularly well to the one-step heat treatment processes according to embodiments of the present disclosure. The Al equivalency is a measure of the alpha stabilizer content of the alloy, and provides an indication of the content of the alpha (α) phase in the AB (or "α-β") titanium alloy. The Al equivalency may be calculated based on the amount of alpha (α) stabilizers and certain neutral elements in the alloy composition, and is calculated by the following Equation 2.

Equation 2–Al Equivalency as measure of Alpha (α) Stabilizer Content $$\text{Al } Eq. = (wt\ \%\ \text{Al}) + 0.33\,(wt\,\%\ \text{Sn}) + 0.16\,(wt\,\%\ \text{Zr}) + 10\,[(wt\,\%\ \text{O}) + (wt\,\%\ \text{C}) + 2\,(wt\,\%\ \text{N})]$$

The alpha (α) stabilizer content, as measured by Al equivalency, may be about 2 to about 7, about 3 to about 7, or about 4 to about 7. In some embodiments, for example, the alpha (α) stabilizer content may be about 2 to about 6, about 2 to about 5, about 3 to about 6, about 3 to about 5, about 4 to about 6, or about 4 to about 5. It is also understood that these ranges also include all sub-ranges and other ranges beginning and/or ending with any point within these ranges, for example, while ranges of about 4 to about 7 and about 4 to about 5 are disclosed above, a range of about 5 to about 7 is also contemplated and included within these ranges. In some embodiments, for example, the alpha (α) stabilizer content may be about 3 to about 6, about 4 to about 6, about 3 to about 5, or about 4 to about 5.

The amount of each of the individual alpha (α) stabilizers is also not particularly limited, and may be selected based on the desired performance or alloy property (e.g., strength, elongation, etc.). However, in some embodiments, the amount of each of the alpha (α) stabilizers may individually be about 7 wt % or lower, for example, about 6 wt % or lower, or about 5 wt % or lower. For example, in some embodiments, the amount of each of the alpha (α) stabilizers may individually be about 0.05 to about 7 wt %, about 0.1 to about 7 wt %, about 0.15 to about 7 wt %, about 0.2 to about 7 wt %, about 0.25 to about 7 wt %, about 0.05 to about 6 wt %, about 0.1 to about 6 wt %, about 0.15 to about 6 wt %, about 0.2 to about 6 wt %, about 0.25 to about 6 wt %, about 0.05 to about 6 wt %, about 0.1 to about 6 wt %, about 0.15 to about 6 wt %, about 0.2 to about 6 wt %, about 0.25 to about 6 wt %, about 0.05 to about 5 wt %, about 0.1 to about 5 wt %, about 0.15 to about 5 wt %, about 0.2 to about 5 wt %, or about 0.25 to about 5 wt %. It is also understood that these ranges also include all sub-ranges and other ranges beginning and/or ending with any point within these ranges, for example, while ranges of about 0.05 to about 7 wt % and about 0.25 to about 7 wt % are disclosed above, a range of about 0.05 to about 0.25 wt % is also contemplated and included within these ranges. In some embodiments, for example, the amount of each of the alpha (α) stabilizers may individually be about 0.1 to about 6 wt %.

The amount of each of the individual neutral elements is also not particularly limited, and may be selected based on the desired performance or alloy property (e.g., strength, elongation, etc.). However, in some embodiments, the amount of each of the neutral elements may individually be about 2 wt % or lower, for example, about 1.5 wt % or lower, or about 1 wt % or lower. For example, in some embodiments, the amount of each of the neutral elements may individually be about 0.1 to about 2 wt %, about 0.15 to about 2 wt %, about 0.2 to about 2 wt %, about 0.25 to about 2 wt %, about 0.3 to about 2 wt %, about 0.35 to about 2 wt %, about 0.4 to about 2 wt %, about 0.45 to about 2 wt %, about 0.5 to about 2 wt %, about 0.55 to about 2 wt %, about 0.6 to about 2 wt %, about 0.65 to about 2 wt %, about 0.7 to about 2 wt %, about 0.75 to about 2 wt %, about 0.8 to about 2 wt %, about 0.85 to about 2 wt %, about 0.9 to about 2 wt %, about 0.95 to about 2 wt %, about 1 to about 2 wt %, about 1.1 to about 2 wt %, about 1.15 to about 2 wt %, about 1.2 to about 2 wt %, about 1.25 to about 2 wt %, about 1.3 to about 2 wt %, about 1.35 to about 2 wt %, about 1.4 to about 2 wt %, about 1.45 to about 2 wt %, about 1.5 to about 2 wt %, about 1.55 to about 2 wt %, about 1.6 to about 2 wt %, about 1.65 to about 2 wt %, about 1.7 to about 2 wt %, about 1.75 to about 2 wt %, about 1.8 to about 2 wt %, about 1.85 to about 2 wt %, about 1.9 to about 2 wt %, about 1.95 to about 2 wt %, about 0.1 to about 1.5 wt %, about 0.15 to about 1.5 wt %, about 0.2 to about 1.5 wt %, about 0.25 to about 1.5 wt %, about 0.3 to about 1.5 wt %, about 0.35 to about 1.5 wt %, about 0.4 to about 1.5 wt %, about 0.45 to about 1.5 wt %, about 0.5 to about 1.5 wt %, about 0.55 to about 1.5 wt %, about 0.6 to about 1.5 wt %, about 0.65 to about 1.5 wt %, about 0.7 to about 1.5 wt %, about 0.75 to about 1.5 wt %, about 0.8 to about 1.5 wt %, about 0.85 to about 1.5 wt %, about 0.9 to about 1.5 wt %, about 0.95 to about 1.5 wt %, about 1 to about 1.5 wt %, about 1.1 to about 1.5 wt %, about 1.15 to about 1.5 wt %, about 1.2 to about 1.5 wt %, about 1.25 to about 1.5 wt %, about 1.3 to about 1.5 wt %, about 1.35 to about 1.5 wt %, about 1.4 to about 1.5 wt %, about 1.45 to about 1.5 wt %, about 0.1 to about 1 wt %, about 0.15 to about 1 wt %, about 0.2 to about 1 wt %, about 0.25 to about 1 wt %, about 0.3 to about 1 wt %, about 0.35 to about 1 wt %, about 0.4 to about 1 wt %, about 0.45 to about 1 wt %, about 0.5 to about 1 wt %, about 0.55 to about 1 wt %, about 0.6 to about 1 wt %, about 0.65 to about 1 wt %, about 0.7 to about 1 wt %, about 0.75 to about 1 wt %, about 0.8 to about 1 wt %, about 0.85 to about 1 wt %, about 0.9 to about 1 wt %, or about 0.95 to about 1 wt %. It is also understood that these ranges also include all sub-ranges and other ranges beginning and/or ending with any point within these ranges, for example, while ranges of about 0.25 to about 1.5 wt % and about 1.25 to about 1.5 wt % are disclosed above, a range of about 0.25 to about 1.25 wt % is also contemplated and included within these ranges. In some embodiments, for example, the amount of each of the neutral elements may individually be about 1 wt % or lower, about 0.5 to about 1.5 wt %, or about 0.25 to about 1.25 wt %.

As would be understood by those of ordinary skill in the art, the amount of Ti in the Alph-Beta, AB (or "α-β") titanium alloy is represented by 100−[total beta (β) stabilizer wt %]−[total alpha (α) stabilizer wt %]−[total neutral element wt %], such that the total wt % of the AB (or "α-β") titanium alloy is 100 wt %.

As discussed above, the Alph-Beta, AB (or "α-β") titanium alloys having the Mo equivalency and/or Al equivalency disclosed herein respond particularly well to the one-step heat treatment process according to embodiments of the present disclosure. For example, while other titanium alloys—including other Alph-Beta, AB (or "α-β") titanium alloys—would require the conventional subsequent aging step to impart the same improvements in mechanical properties, the Alph-Beta, AB (or "α-β") titanium alloys having the Mo equivalency and/or Al equivalency disclosed herein surprisingly exhibit improved mechanical properties after undergoing only solution treatment with no aging procedure. This makes these alloys, and components made from them particularly useful for the manufacture of—among other things—golf clubs, and particularly for the manufacture of golf club heads, and golf club head striking faces or striking face inserts.

Golf club heads include the body of the golf club head, and the striking face—i.e., the face of the golf club head that strikes the golf ball. Naturally, the striking face of the golf club head experiences maximum stress and therefore must be very strong. Also, because the golf club head strikes the ball thousands of time during the life of the golf club, the material of the golf club head—and particularly the striking face—must have good fatigue strength under impact. These requirements translate to the need for a component material—here, a titanium alloy—with high strength and high ductility. However, strength and ductility typically move in opposite directions—i.e., improvements in strength typically result in lower elongation (or ductility), and vice versa. Therefore, it is exceedingly difficult to design and manufacture a golf club head or striking face insert that has sufficient strength to resist deformation and fracture while also having sufficient elongation (or ductility) to avert fatigue crack formation.

As discussed herein, while the strength of titanium alloys has been manipulated using the conventional two-step approach of solution treatment and aging, this conventional process requires the added step of aging, which increases the time and cost of manufacture. Additionally, as also discussed herein, the aging process can cause significant buildup of internal stresses leading to physical deformations of the component (e.g., the golf club head or the striking face insert). These deformations then require the post-treatment mechanical processing—e.g., hand polishing, etc.—of the component to return the component to the desired geometry, shape, or dimensions before it is suitable for use.

In contrast, the one-step solution treatment process according to the present disclosure results in components having good strength properties while maintaining elongation within acceptable ranges. While in some cases the one-step solution treatment process of the present disclosure may result in lower elongation than the as-formed component before the solution treatment, the elongation resulting from the one-step solution treatment is still within acceptable levels for use in golf club heads and striking face inserts for golf club heads.

For example, in some embodiments, the component (e.g., the striking face insert) formed from the Alph-Beta, AB (or "α-β") titanium alloys disclosed herein may have an Ultimate Tensile Strength (UTS) of about 140 ksi or greater (or about 965 MPa or greater). In some embodiments, for example, the Alph-Beta, AB (or "α-β") titanium alloys may have a UTS of about 145 ksi or greater (about 1000 MPa or greater), about 150 ksi or greater (about 1034 MPa or greater), about 155 ksi or greater (about 1069 MPa or greater), about 160 ksi or greater (about 1103 MPa or greater), about 165 ksi or greater (about 1138 MPa or greater), or about 170 ksi or greater (about 1172 MPa or greater). In some embodiments, for example, the AB (or "α-β") titanium alloys may have a UTS of about 140 ksi to about 200 ksi, about 140 ksi to about 190 ksi, about 140 ksi to about 185 ksi, about 140 ksi to about 180 ksi, about 140 ksi to about 175 ksi, about 145 ksi to about 200 ksi, about 145 ksi to about 190 ksi, about 145 ksi to about 185 ksi, about 145 to about 180 ksi, about 145 ksi to about 175 ksi, about 150 ksi to about 200 ksi, about 150 ksi to about 190 ksi, about 150 ksi to about 185 ksi, about 150 ksi to about 180 ksi, about 150 ksi to about 175 ksi, about 155 ksi to about 200 ksi, about 155 ksi to about 190 ksi, about 155 ksi to about 185 ksi, about 155 to about 180 ksi, about 155 ksi to about 175 ksi, about 160 ksi to about 200 ksi, about 160 ksi to about 190 ksi, about 160 ksi to about 185 ksi, about 160 ksi to about 180 ksi, about 160 to about 175 ksi, about 165 ksi to about 200 ksi, about 165 ksi to about 190 ksi, about 165 ksi to about 185 ksi, about 165 ksi to about 180 ksi, about 165 ksi to about 175 ksi, about 170 ksi to about 200 ksi, about 170 ksi to about 190 ksi, about 170 ksi to about 185 ksi, about 170 ksi to about 180 ksi, or about 170 ksi to about 175 ksi. It is also understood that these ranges also include all sub-ranges and other ranges beginning and/or ending with any point within these ranges, for example, while ranges of about 140 to about 200 ksi and about 165 to about 175 ksi are disclosed above, ranges of about 140 ksi to about 175 ksi and about 165 ksi to about 200 ksi are also contemplated and included within these ranges.

Additionally, in some embodiments, the component (e.g., the striking face insert) formed from the Alph-Beta AB (or "α-β") titanium alloys disclosed herein may have a Yield Strength (YS) of about 100 ksi or greater (or about 689 MPa or greater). In some embodiments, for example, the AB (or "α-β") titanium alloys may have a YS of about 110 ksi or greater (about 758 MPa or greater), about 120 ksi or greater (about 827 MPa or greater), about 130 ksi or greater (about 896 MPa or greater), about 140 ksi or greater (about 965 MPa or greater), or about 150 ksi or greater (about 1034 MPa or greater). In some embodiments, for example, the AB (or "α-β") titanium alloys may have a YS of about 100 ksi to about 200 ksi, about 100 ksi to about 190 ksi, about 100 ksi to about 180 ksi, about 100 ksi to about 175 ksi, about 100 ksi to about 170 ksi, about 100 ksi to about 165 ksi, about 100 ksi to about 160 ksi, about 100 ksi to about 155 ksi, about 110 ksi to about 200 ksi, about 110 ksi to about 190 ksi, about 110 ksi to about 180 ksi, about 110 ksi to about 175 ksi, about 110 ksi to about 170 ksi, about 110 ksi to about 165 ksi, about 110 ksi to about 160 ksi, about 110 ksi to about 155 ksi, about 120 ksi to about 200 ksi, about 120 ksi to about 190 ksi, about 120 ksi to about 180 ksi, about 120 ksi to about 175 ksi, about 120 ksi to about 170 ksi, about 120 ksi to about 165 ksi, about 120 ksi to about 160 ksi, about 120 ksi to about 155 ksi, about 130 ksi to about 200 ksi, about 130 ksi to about 190 ksi, about 130 ksi to about 180 ksi, about 130 ksi to about 175 ksi, about 130 ksi to about 170 ksi, about 130 ksi to about 165 ksi, about 130 ksi to about 160 ksi, about 130 ksi to about 155 ksi, about 140 ksi to about 200 ksi, about 140 ksi to about 190 ksi, about 140 ksi to about 180 ksi, about 140 ksi to about 175 ksi, about 140 ksi to about 170 ksi, about 140 ksi to about 165 ksi, about 140 ksi to about 160 ksi, about 140 ksi to about 155 ksi, about 150 ksi to about 200 ksi, about 150 ksi to about 190 ksi, about 150 ksi to about 180 ksi, about 150 ksi to about 175 ksi, about 150 ksi to about 170 ksi, about 150 ksi to about 165 ksi, about 150 ksi to about 160 ksi, or about 150 ksi to about 155 ksi. It is also understood that these ranges also include all sub-ranges and other ranges beginning and/or ending with any point within these ranges, for example, while ranges of about 130 to about 200 ksi and about 140 to about 170 ksi are disclosed above, ranges of about 125 ksi to about 170 ksi and about 145 ksi to about 155 ksi are also contemplated and included within these ranges.

Further, according to embodiments of the present disclosure, the component (e.g., the striking face insert) formed from the Alph-Beta, AB (or "α-β") titanium alloys disclosed herein have acceptable elongation properties. For example, in some embodiments, the component (e.g., the striking face insert) formed from the Alph-Beta, AB (or "α-β") titanium alloys disclosed herein have a percent elongation of about 5 or greater. In some embodiments for example, the alloys may have a percent elongation of about 6 or greater, about 8 or greater, or about 9 or greater. For example, in some embodiments, the Alph-Beta, AB (or "α-β") titanium alloys may have a percent elongation of about 5 to about 20, about 5 to about 15, about 5 to about 10, about 6 to about 20, about 6 to about 15, about 6 to about 10, about 8 to about 20, about 8 to about 15, about 8 to about 10, about 9 to about 20, about 9 to about 15, or about 9 to about 10. It is also understood that these ranges also include all sub-ranges and other ranges beginning and/or ending with any point within these ranges, for example, while ranges of about 5 to about 20 and about 9 to about 10 are disclosed above, a range of about 5 to about 9 is also contemplated and included within these ranges.

In addition, according to embodiments of the present disclosure, the component (e.g., the striking face insert) formed from the Alph-Beta, AB (or "α-β") titanium alloys disclosed herein may have a Young's Modulus of about 100 GPa or greater. In some embodiments for example, the components may have a Young's Modulus of about 105 GPa or greater, or about 110 GPa or greater. For example, in some embodiments, the component (e.g., the striking face insert) formed from the Alph-Beta, AB (or "α-β") titanium alloys disclosed herein may have a Young's Modulus of about 100 GPa to about 140 GPa, about 100 GPa to about 130 GPa, about 100 GPa to about 125 GPa, about 100 GPa to about 120 GPa, about 105 GPa to about 140 GPa, about 105 GPa to about 130 GPa, about 105 GPa to about 125 GPa, about 105 GPa to about 120 GPa, about 110 GPa to about 140 GPa, about 110 GPa to about 130 GPa, about 110 GPa to about 125 GPa, or about 110 GPa to about 120 GPa. It is also understood that these ranges also include all sub-ranges and other ranges beginning and/or ending with any point within these ranges, for example, while ranges of about 100 GPa to about 120 GPa and about 110 GPa to about 140 GPa are disclosed above, ranges of about 100 GPa to about 110 GPa and about 100 GPa to about 115 GPa are also contemplated and included within these ranges.

Also, in some embodiments, the component (e.g., the striking face insert) formed from the Alph-Beta, AB (or "α-β") titanium alloys disclosed herein may have a Poisson's ratio value of about 0.3 to about 0.4. In some embodiments for example, the alloys may have a Poisson's ratio value of about 0.31 to about 0.35, or about 0.31 to about 0.34.

The component (e.g., the striking face insert) formed from the Alph-Beta, AB (or "α-β") titanium alloys disclosed herein may also have a density of about 3 to about 6 g/cm$^3$. For example, in some embodiments, the components may have a density of about 3 to about 5.9 g/cm$^3$, about 3 to about 5.8 g/cm$^3$, about 3 to about 5.7 g/cm$^3$, about 3 to about 5.6 g/cm$^3$, about 3 to about 5.5 g/cm$^3$, about 3 to about 5.4 g/cm$^3$, about 3 to about 5.3 g/cm$^3$, about 3 to about 5.2 g/cm$^3$, about 3 to about 5.1 g/cm$^3$, about 3 to about 5 g/cm$^3$, 3 to about 4.9 g/cm$^3$, about 3 to about 4.8 g/cm$^3$, about 3 to about 4.7 g/cm$^3$, about 3 to about 4.6 g/cm$^3$, or about 3 to about 4.5 g/cm$^3$. It is also understood that these ranges also include all sub-ranges and other ranges beginning and/or ending with any point within these ranges, for example, while ranges of about 3 to about 4.5 g/cm$^3$ and about 3 to about 4 g/cm$^3$ are disclosed above, ranges of about 4 to about 4.5 g/cm$^3$ and about 3.3 to about 4.5 g/cm$^3$ are also contemplated and included within these ranges.

The properties discussed above are indicative of the improved characteristics of the components (e.g., the striking face insert, or fully manufactured gold club head) after undergoing the one-step heat treatment procedure according to embodiments of the present disclosure. However, it is also important to compare these post heat-treatment properties with the corresponding properties pre-treatment. Such a comparison shows the unique benefits of the one-step heat treatment processes according to the present disclosure. To illustrate this, the alloy Ti-HEG (available from O—Ta Precision Industry Co., Ltd., Taiwan) was used for this comparison. Table 1 below compares the UTS, YS, elongation, Young's modulus, Poisson's ratio, and density of striking face inserts formed of the Ti-HEG alloy both before and after the one-step heat treatment process according to embodiments of the present disclosure. In both cases, the striking face insert was prepared by mill annealing and heat exposure (to impart the desired curvature to the striking face insert). But the second striking face insert was subsequently heat treated using the one-step process according to embodiments of the present disclosure—i.e., heat-treated at a temperature of 830 C for a period of 30 minutes, followed by flooding the heating chamber with Ar gas to aid cooling of the insert to ambient temperature.

TABLE 1

| Alloy | Treatment Process | UTS | YS | % Elong. | Young's Modulus | Poisson's Ratio | Density |
|---|---|---|---|---|---|---|---|
| Ti-HEG | Mill Anneal + Heat Exposure | 152 ksi (1046 MPa) | 139.0 ksi (959 MPa) | 17.2 | 113.6 GPa | 0.3098 | 4.43 |
| Ti-HEG | Mill Anneal + Heat Exposure + one-step solution heat treatment | 171 ksi (1179 MPa) | 154.5 ksi (1065 MPa) | 9.3 | 113.4 GPa | 0.3119 | 4.43 |

As can be seen in the above comparison, the one-step solution treatment according to embodiments of the present disclosure impart significantly improved strength characteristics—showing markedly more than 10% increases in both UTS and YS—while having little or no effect on Young's Modulus, Poisson's ratio, or density, and maintaining elongation within an acceptable and serviceable range.

The component (e.g., the striking face insert or golf club head including the striking face insert) formed from the Alph-Beta, AB (or "α-β") titanium alloys according to embodiments of the present disclosure may be manufactured by any suitable procedure. To aid this discussion, reference is made to FIG. 1, which depicts a golf club head 100 having an aft body portion 104, a striking face portion 102, and a striking face insert 103. According to some embodiments, a method of making a golf club head 100 may include first separately manufacturing (or providing) an aft body portion 104 and a striking face insert 103. In some embodiments, only the striking face insert may be subjected to the one-step heat treatment procedure according to embodiments of the present disclosure. After the one-step treatment, the as-treated striking face insert may be welded to (or otherwise attached) to the aft body portion to complete the golf club head. However, in some instances, welding (or attaching) the treated insert to the aft body portion can create heat affected zones in the golf club head. While the golf club heads made in this manner—and potentially including one or more heat affected zones—do have the requisite mechanical properties, and are therefore still improved by the one-step process, it may be desirable to avoid generating these heat affected zones.

Accordingly, in some embodiments, a method of making a golf club head may include first separately manufacturing (or providing) an aft body portion and a striking face insert, and then welding (or otherwise attaching) the striking face insert to the aft body portion. In these embodiments, the striking face insert is attached to the aft body portion prior to the one-step solution treatment procedure according to embodiments of the present disclosure. And the entire assembled golf club head—with aft body portion and attached striking face insert—is subjected to the one-step solution treatment process. As the one-step heat treatment is performed on the entire golf club head (i.e., post attachment of the striking face insert), in these embodiments, the resulting golf club head does not include heat affected zones, or includes only minimal such heat affected zones.

Each of the aft body portion and the striking face insert may be manufactured by any suitable means, without limitation. And in some embodiments, while the striking face insert is made from the Alph-Beta, AB (or "α-β") titanium alloys described herein, the aft body portion may be made from the same or similar alloy, or may be made from a different titanium alloy. Indeed, in some embodiments, the aft body portion and the striking face insert may be made of different alloys, establishing a relative difference between the components that allows the two components to function together synergistically to create improvements in golf club head performance.

As noted above, the material of the aft body portion of the golf club head is not particularly limited, and may be any titanium alloy suitable for use in golf club heads. Many such titanium alloys are known, all of which are suitable for use according to embodiments of the present disclosure. For example, in some embodiments, the aft body portion may be made of a cast titanium alloy, non-limiting examples of which include Ti-8Al-1V-1Mo, Ti-6-4, Ti-5Al-1Sn-1Zr-1V-0.8Mo, Ti-3Al-2.5Sn, and Ti-3Al-2V. And in some embodiments, the aft body portion may be made of a Ti-8Al-1V-1Mo alloy. Additional details of the aft body portion, including specific mechanical properties suitable for embodiments of the present disclosure may be found in co-pending U.S. patent application Ser. No. 17/877,138, titled "IMPROVED STRIKING FACE OF A GOLF CLUB HEAD," filed on Jul. 29, 2022 in the name of Acushnet Company (Fairhaven, MA), the entire content of which is incorporated herein by reference for all purposes.

As mentioned above, the striking face insert may also be manufactured by any suitable means so long as it is formed from one of the Alph-Beta, AB (or "α-β") titanium alloys according to embodiments of the present disclosure. Additionally, while the striking face insert must be compatible with, and shaped to fit within an appropriate face of its corresponding aft body portion, the shape, size, geometry, dimensions, curvature, thickness, etc. of the striking face insert is not particularly limited. Indeed, one significant advantage of the one-step solution treatment process described herein is the ability to improve the mechanical properties and performance characteristics of any striking face insert formed of one the Alph-Beta, AB (or "α-β") titanium alloys according to embodiments of the present disclosure. In some embodiments, however, the striking face insert may have the structure, geometry, dimensions (including variable thickness regions), etc. of the striking face insert disclosed in co-pending U.S. patent application Ser. No. 17/877,138, titled "IMPROVED STRIKING FACE OF A GOLF CLUB HEAD," filed on Jul. 29, 2022 in the name of Acushnet Company (Fairhaven, MA), the entire content of which is incorporated herein by reference for all purposes.

To create a striking face insert suitable for a striking face of a golf club head, the face insert may first be forged to have the desired shape, curvature, geometry, and dimensions (e.g., thickness). For instance, the curved shape may be defined at least in part by the bulge and roll of the striking face insert 103. According to some embodiments, the geometry of the face insert may be forged by a stamped forging process that uses a die assembly. The die assembly may include a top punch or male die that has a protrusion created in roughly the shape of the desired striking face insert geometry (e.g., desired thickness, curvature, etc.). The die assembly may further include a bottom cavity or female die that has a corresponding depression that also corresponds to the desired geometry. According to the stamped forging process, the top punch applies pressure onto the striking face insert to deform the face insert into the desired shape.

According to some embodiments, the striking face insert may be heated to an elevated temperature during the stamped forging process. This heat exposure makes the alloy more ductile, which enables easier forging of the striking face insert with the desired geometry, and in particular, the desired curvature. The temperature of this heat exposure is not particularly limited, but should be lower than the beta transus temperature of the alloy of the striking face insert, but high enough to enable manipulation of the alloy into the desired geometry. In some embodiments, for example, the heat exposure temperature may be between about 740 C and 780 C, for example about 760 C.

Figure 2:
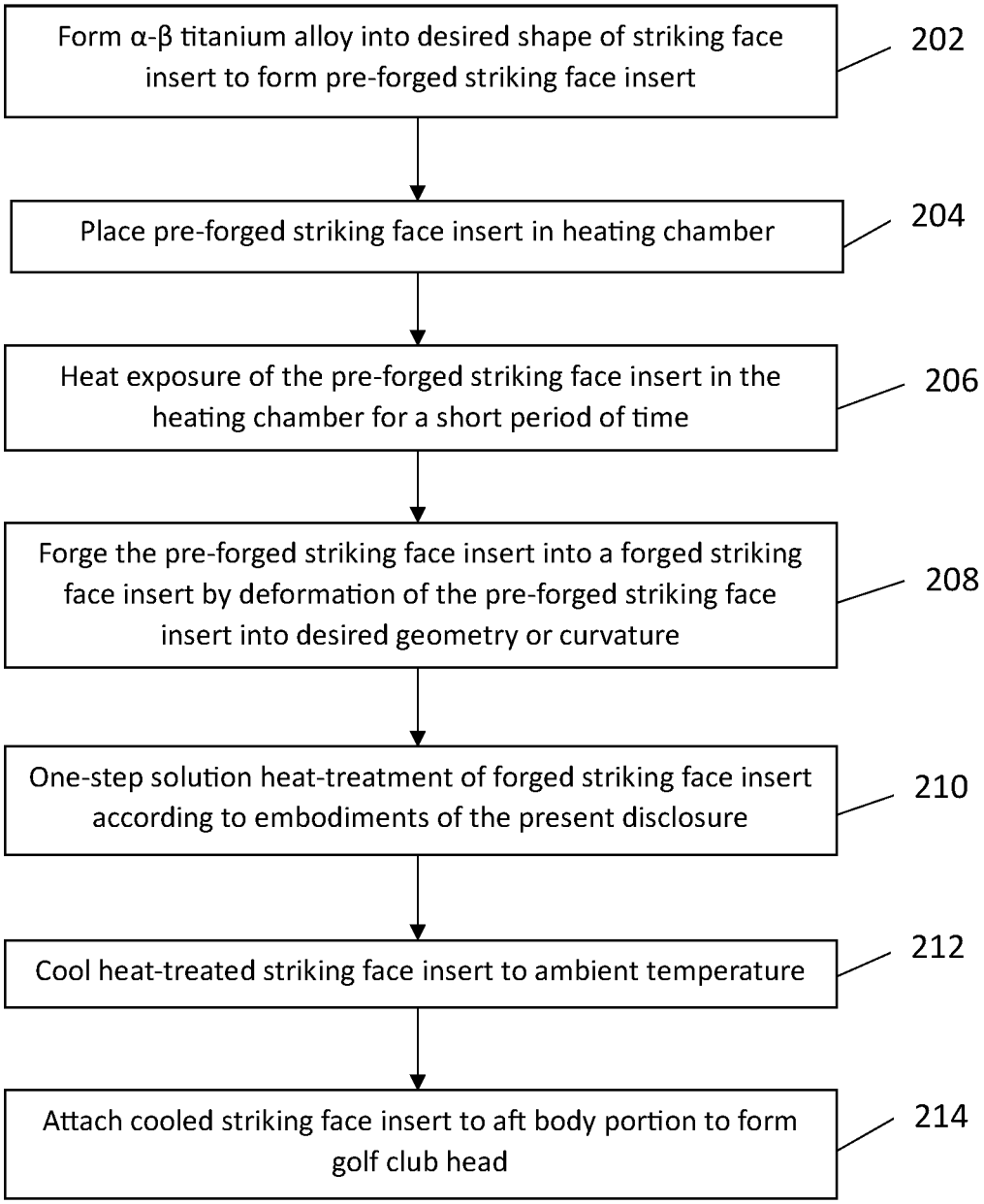
FIG. 2 is a flowchart depicting an example method for manufacturing a striking face insert and golf club head according to embodiments of the present disclosure.

After forging the striking face insert (with or without the heat exposure discussed above), the forged striking face insert is subjected to the one-step solution treatment process according to embodiments of the present disclosure. Accordingly, some embodiments of the present disclosure are directed to a method of manufacturing a striking face insert for a golf club head. FIG. 2 is a flowchart depicting an example method of manufacturing a striking face insert according to some embodiments of the present disclosure.

As shown in FIG. 2, at operation 202, an Alph-Beta, AB (or "α-β") titanium alloy as described herein is cut into the shape of a striking face insert to form a pre-forged striking face insert. The cutting of the of the titanium alloy may be performed via laser cutting or any other suitable method for cutting titanium alloys. For example, the titanium alloy may be formed as a sheet, and the pre-forged striking face insert may be cut from the sheet.

At operation 204, the pre-forged striking face insert is introduced into a heating chamber or heating apparatus for heat exposure. The duration of the heat exposure may be less than about ten minutes. In some examples, the duration may be between about 6-8 minutes or about 7 minutes. The heating apparatus is not particularly limited, and may be any suitable heating apparatus, nonlimiting examples of which include rotary ovens or similar heating apparatus suitable for heating titanium alloys to the temperatures described herein.

At operation 206, the heating apparatus heat exposes the pre-forged striking face insert to a temperature that remains below the beta-transus temperature of the particular titanium alloy that forms the pre-forged face insert. For instance, as discussed generally above, the pre-forged striking face insert may be heated to a temperature between about 740 C and 780 C, for example, about 760 C. In some embodiments, the heat exposure operation may be conducted under vacuum.

Heating the pre-forged striking face insert at the heat exposure stage may be accomplished by setting the heating apparatus to the desired temperature (e.g., 760° C.) and leaving the pre-forged striking face insert in the heating apparatus until the pre-forged face insert reaches that desired temperature. In other examples, the heating apparatus may be set to a temperature higher than the desired temperature of the pre-forged striking face insert (e.g., higher than 760° C.), and the pre-forged striking face insert may be left in the heating apparatus for a duration that results in the pre-forged striking face insert reaching the desired temperature. For instance, once the pre-forged striking face insert reaches the desired temperature, the pre-forged face insert may be removed from the heating apparatus. Removing the heated pre-forged striking face insert may be accomplished automatically or manually, such as through the use of heat-resistant tongs.

As discussed generally herein, this heat exposure of the pre-forged striking face insert may be useful in performing the forging processes discussed herein. Indeed, cold forming a titanium alloy (e.g., forming the titanium alloy at room temperature) requires substantial amounts of force, and even at these high levels of force, the deformation needed to achieve the desired geometry or curvature of the striking face insert may not even be possible. When the titanium alloy is heated, however, it becomes softer or more ductile, meaning that less force is required to form or deform the titanium alloy during the forging process.

Referring back to FIG. 2, at operation 208, the heat exposed, pre-forged striking face insert is forged to form a forged striking face insert. Forging of the striking face insert may be accomplished through a stamped forging process that uses a male die and a female die, or top punch and bottom cavity, as discussed generally herein. Additional details regarding a stamped forging process are provided in U.S. Patent Publication No. 2013/0303305, titled "STRIKING FACE OF A GOLF CLUB HEAD AND METHOD OF MANUFACTURING THE SAME," filed on May 9, 2012 in the name of Acushnet Company (Fairhaven, MA), the entire content of which is incorporated herein by reference for all purposes. In some examples, the portions of the forging or die assembly may be heated to not cause rapid cooling of the striking face insert when contacting the striking face insert during the forging process. Once the forging process is complete, the forged striking face insert may be allowed to cool to set the deformations caused by the forging process.

After forging the striking face insert to have the desired shape, geometry, and curvature, the striking face insert is subjected to the one-step solution treatment process according to embodiments of the present disclosure. For example, the forged striking face insert is again placed in the heating apparatus at operation 210. The heating apparatus heats the forged striking face insert to the temperature described herein for the one-step solution treatment. For instance, as discussed generally above, the forged striking face insert may be heated to a temperature between about 780 C and about 880 C, for example, about 830 C. This heating is carried out for a period of time sufficient to effect solution treatment, e.g., conversion of about 70% or more of the alpha phase in the alloy to the beta phase. According to some embodiments, for example, this heating is carried out for a period of about 15 minutes to about 45 minutes, for example, about 30 minutes. In some embodiments, the one-step solution heating operation is conducted under vacuum.

After completion of the one-step solution treatment procedure, the forged striking face insert is cooled to ambient temperature at operation 212. As discussed herein, this cooling may be effected by any suitable means, without limitation. In some embodiments, for example, the forged striking face insert may be cooled by leaving it in the heating apparatus with the heat turned off until the striking face insert cools to ambient temperature. Alternatively, the striking face insert may be removed from the heating apparatus and allowed to cool to ambient temperature. In some embodiments, however, the forged striking face insert may be cooled to ambient temperature by turning off the heat to the heating apparatus, and flooding the apparatus with an inert gas (e.g., Ar). This flooding with an inert gas serves to avoid oxidation of the alloy during the cooling process.

Once the forged striking face insert has been formed, the forged striking face insert may undergo additional manufacturing processes before the forged striking face insert is attached to the remainder or aft body portion of the golf club head to form the striking face of the golf club head. For example, the forged face insert may be machined or hand polished to restore the original geometry, shape, or curvature of the striking face insert. However, in some embodiments of the present disclosure, the one-step solution treatment procedure minimizes or eliminates the need for this post-treatment machining or processing. Accordingly, in some embodiments, the treated striking face insert may be attached to the aft body portion of the golf club head directly after the one-step solution treatment without the need for any additional processing or machining. In some embodiments, however, the treated striking face insert may be subjected to certain aesthetic manufacturing processing to impart the desired aesthetic look and feel to the striking face insert. Some nonlimiting examples of these other or additional aesthetic manufacturing steps include polishing, sandblasting, etching (e.g., laser etching), etc.

Returning to FIG. 2 and with reference to FIG. 1, at operation 214, the forged striking face insert is attached to the aft body portion 104 of the golf club head to form a striking face 102 of the golf club head 100.

As described above, this method involves performing the one-step heat treatment procedure on the striking face insert before attaching the striking face insert to the aft body portion of the golf club head. However, in some embodiments, the striking face insert may be attached to the aft body portion of the golf club head prior to performing the one-step solution treatment. In these embodiments, therefore, the entire golf club head—with striking face insert attached—is subjected to the one-step solution treatment procedure. An example of such a method is illustrated in the flowchart of FIG. 3.

Figure 3:
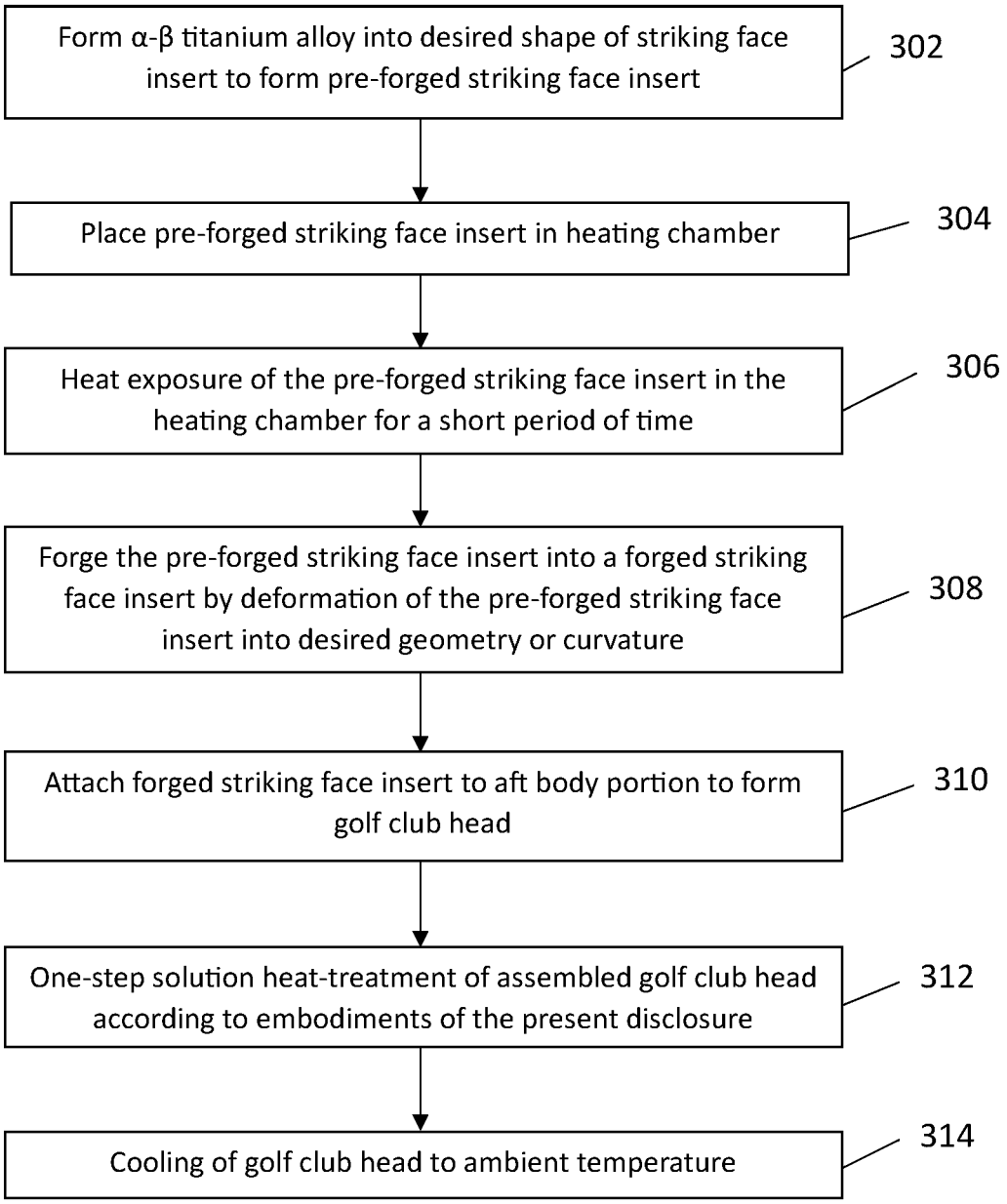
FIG. 3 is a flowchart depicting an example method for manufacturing a golf club head according to embodiments of the present disclosure.

In FIG. 3, operations 302, 304, 306, and 308 are substantially the same as operations 202, 204, 206, and 208 in the method described above and depicted in FIG. 2. However, in the method depicted in FIG. 3, at operation 310, the forged striking face insert is attached to the aft body portion 104 of the golf club head to form a striking face 102 of the golf club head 100.

And at operation of 312, the entire golf club head—including the aft body portion with attached striking face insert—is subjected to the one-step solution treatment process according to embodiments of the present disclosure. The one-step solution treatment operation 312 of FIG. 3 is substantially the same as that described herein for operation 210 of FIG. 2 except that the entire golf club head—rather than only the striking face insert—is subjected to the one-step heat treatment operation.

After completion of the one-step solution treatment procedure at operation of 312, the treated golf club head is cooled to ambient temperature at operation 314. Operation 314 of FIG. 3 is substantially the same as operation 212 of FIG. 2 except that the entire golf club head is subjected to the cooling procedure. After cooling at operation 314, the treated golf club head may undergo additional manufacturing processes, as described above in connection with the striking face insert and FIG. 2.

EXAMPLES

The following examples and comparative examples are presented for illustrative purposes only, and do not limit the scope or content of the present disclosure or claims.

Example 1

Four striking face insert components were cut from the commercially available alloy, Ti-HEG available from O—Ta Precision Industry Co., Ltd. (Taiwan). The striking face insert components were forged into striking face inserts by mill annealing and heat exposure. The forged striking face insert components were then subjected to a single, one-step solution treatment operation including heating the striking face insert at a temperature of 830 C under vacuum for a period of 30 minutes. The heating apparatus was then flooded with argon gas, and the treated striking face inserts were cooled to ambient temperature. After cooling, the treated striking face inserts were welded to aft body portions of golf clubs. The aft body portions were formed of a cast Ti-8Al-1V-1Mo alloy. The resulting golf club heads were attached to shafts, and the resulting golf clubs were tested for durability.

Example 2

Four striking face insert components were cut from the commercially available alloy, Ti-HEG, available from O—Ta Precision Industry Co., Ltd. (Taiwan). The striking face insert components were forged into striking face inserts by mill annealing and heat exposure. The forged striking face insert components were then welded to aft body portions of golf clubs. The aft body portions were formed of a cast Ti-8Al-1V-1Mo alloy. The entire assembled golf club heads—including the striking face inserts welded to the aft body portions—were subjected to a single, one-step solution treatment operation including heating the golf club heads at a temperature of 830 C under vacuum for a period of 30 minutes. The heating apparatus was then flooded with argon gas, and the treated golf club heads were cooled to ambient temperature. The resulting treated golf club heads were attached to shafts, and the resulting golf clubs were tested for durability.

Upon durability testing—including impact testing by subjecting the golf club heads to 3,000 hits—three of the four golf club heads from Example 1 passed 3,000 hits without failures. These golf club heads also measured a maximum bulge gap of 0.254 mm, and a maximum roll gap of 0.406 mm.

Upon the same durability testing, 2 of the four golf club heads of Example 2 passed 3,000 hits without failures. These golf club heads also measured a maximum bulge gap of 0.178 mm, and a maximum roll gap of 0.381. These slightly improved bulge and roll gap measurements indicate that performing the single, one-step heat treatment procedure on the entire golf head yields a slight advantage over performing the single-step heat treatment on the striking face insert separately. However, both Examples show that the golf club heads manufactured according to all methods disclosed herein have good durability.

While certain exemplary embodiments of the present disclosure have been illustrated and described, those of ordinary skill in the art will recognize that various changes and modifications can be made to the described embodiments without departing from the spirit and scope of the present disclosure, and equivalents thereof, as defined in the claims that follow this description. For example, although certain components may have been described in the singular, i.e., "a" neutral element, "an" alpha (α) stabilizer and the like, one or more of these components in any combination can be used according to the present disclosure, unless otherwise stated to the contrary. However, it is understood by the disclosure herein, that the single-step heat treatment procedure includes only the singular, and does not encompass the plural.

Also, although certain embodiments have been described as "comprising" or "including" the specified components, embodiments "consisting essentially of" or "consisting of" the listed components are also within the scope of this disclosure. For example, while embodiments of a method of manufacturing a golf club head comprises forging the striking face insert, and subjecting either the striking face insert or the entire golf club head to the single-step heat treatment operation, embodiments consisting essentially of or consisting of these components are also within the scope of this disclosure. Accordingly, a method of manufacturing a golf club head may consist essentially of forging the striking face insert, attaching the striking face insert to an aft body portion of a golf club head, and subjecting either the striking face insert or the entire golf club head to the single-step heat treatment operation. In this context, "consisting essentially of" means that any additional components, elements, or method steps will not materially affect the chemical, physical or mechanical properties of the final golf club head, including, e.g., geometry, structure, strength, or elongation. For example, while "consisting essentially of" excludes additional heat-treatment steps, "consisting essentially of" in this context is not intended to exclude assembly of the finished striking face insert into a golf club head by, for example, welding or otherwise attaching the striking face insert to the aft body portion, or assembly of the finished golf club head into a golf club by, for example, attaching the golf club head to a shaft.

As used herein, unless otherwise expressly specified, all numbers such as those expressing values, ranges, amounts or percentages may be read as if prefaced by the word "about," even if the term does not expressly appear. Further, the word "about" is used as a term of approximation, and not as a term of degree, and reflects the penumbra of variation associated with measurement, significant figures, and interchangeability, all as understood by a person having ordinary skill in the art to which this disclosure pertains. Any numerical range recited herein is intended to include all sub-ranges subsumed therein. Plural encompasses singular and vice versa. When ranges are given, any endpoints of those ranges and/or numbers within those ranges can be combined within the scope of the present disclosure. The terms "including" and like terms mean "including but not limited to," unless specified to the contrary.

Additionally, as discussed above, all weight percentages of elements within the alloys described herein are nominal weight percentages, unless expressly stated to the contrary. This includes the weight percentages listed in the Examples.

Notwithstanding that the numerical ranges and parameters set forth herein may be approximations, numerical values set forth in the Examples are reported as precisely as is practical. Any numerical value, however, inherently contains certain errors necessarily resulting from the standard variation found in their respective testing measurements. The word "comprising" and variations thereof as used in this description and in the claims do not limit the disclosure to exclude any variants or additions.

What is claimed is:

1. A method for manufacturing a striking face insert configured for use in a golf club head, the method comprising:

forming a pre-forged striking face insert from an alpha-beta (α-β) titanium alloy having an Al equivalency as calculated using Equation 2 of about 2 to about 7;

forging the pre-forged striking face insert into a forged striking face insert having a specified geometry or curvature;

performing only a single-step heat-treatment on the forged striking face insert, the single-step heat-treatment comprising heating the forged striking face insert in a heating chamber to a temperature of about 780 C to about 880 C for about 15 to about 45 minutes; and thereafter cooling the forged striking face insert to ambient temperature, $$\text{Al Eq.}=(wt\%\ \text{Al})+0.33(wt\%\ \text{Sn})+0.16(wt\%\ \text{Zr})+10[(wt\%\ \text{O})+(wt\%\ \text{C})+2(wt\%\ \text{N})]. \quad \text{Equation 2}$$

2. The method according to claim 1, wherein the α-β titanium alloy comprises a Ti—Al—V—Mo—Fe or Ti—Al—V—Fe—Cr alloy and has a Molybdenum equivalency as calculated using Equation 1 of about 6 to about 12:

$$\text{Mo Eq.}=(wt\%\ \text{Mo})+0.2(wt\%\ \text{Ta})+0.28(wt\%\ \text{Nb})+0.4(wt\%\ \text{W})+0.67(wt\%\ \text{V})+1.25(wt\%\ \text{Cr})+1.25(wt\%\ \text{Ni})+1.7(wt\%\ \text{Mn})+1.7(wt\%\ \text{Co})+2.9(wt\%\ \text{Fe}). \quad \text{Equation 1}$$

3. The method according to claim 1, wherein the forging the pre-forged striking face insert comprises heat exposure of the pre-forged striking face, and deforming the pre-forged striking face insert during or after the heat exposure to form the forged striking face insert having the specified geometry or curvature.

4. The method according to claim 3, wherein the heat exposure comprises heating the pre-forged striking face to an exposure temperature below the beta transus temperature of the α-β titanium alloy.

5. The method according to claim 3, wherein the heat exposure comprises heating the pre-forged striking face to a temperature of about 740 C to about 780 C.

6. The method according to claim 1, wherein the cooling comprises flooding the heating chamber with an inert gas.

7. The method according to claim 6, wherein the inert gas comprises argon gas.

8. The method according to claim 1, wherein the striking face insert has a Young's Modulus of at least about 100 gigapascals (GPa).

9. The method according to claim 1, wherein the striking face insert has a Young's Modulus of about 100 GPa to about 115 GPa.

10. The method according to claim 1, wherein the single-step heat-treatment is performed under vacuum.

11. A method for manufacturing a golf club head, the method comprising:

forming a pre-forged striking face insert from an alpha-beta (α-β) titanium alloy having an Al equivalency as calculated using Equation 2 of about 2 to about 7;

forging the pre-forged striking face insert into a forged striking face insert having a specified geometry or curvature;

attaching the forged striking face insert to an aft body portion to form a golf club head;

performing only a single-step heat-treatment on the golf club head, the single-step heat-treatment comprising heating the golf club head in a heating chamber to a temperature of about 780 C to about 880 C for about 15 to about 45 minutes; and thereafter cooling the golf club head to ambient temperature:

$$\text{Al Eq.}=(wt\%\ \text{Al})+0.33(wt\%\ \text{Sn})+0.16(wt\%\ \text{Zr})+10[(wt\%\ \text{O})+(wt\%\ \text{C})+2(wt\%\ \text{N})]. \quad \text{Equation 2}$$

12. The method according to claim 11, wherein the α-β titanium alloy comprises a Ti—Al—V—Mo—Fe or Ti—Al—V—Fe—Cr alloy and has a Molybdenum equivalency as calculated using Equation 1 of about 6 to about 12:

$$\text{Mo Eq.}=(wt\%\ \text{Mo})+0.2(wt\%\ \text{Ta})+0.28(wt\%\ \text{Nb})+0.4(wt\%\ \text{W})+0.67(wt\%\ \text{V})+1.25(wt\%\ \text{Cr})+1.25(wt\%\ \text{Ni})+1.7(wt\%\ \text{Mn})+1.7(wt\%\ \text{Co})+2.9(wt\%\ \text{Fe}). \quad \text{Equation 1}$$

13. The method according to claim 11, wherein the forging the pre-forged striking face insert comprises heat exposure of the pre-forged striking face, and deforming the pre-forged striking face insert during or after the heat exposure to form the forged striking face insert having the specified geometry or curvature.

14. The method according to claim 13, wherein the heat exposure comprises heating the pre-forged striking face to an exposure temperature below the beta transus temperature of the α-β titanium alloy.

15. The method according to claim 13, wherein the heat exposure comprises heating the pre-forged striking face to a temperature of about 740 C to about 780 C.

16. The method according to claim 11, wherein the cooling comprises flooding the heating chamber with an inert gas.

17. The method according to claim 16, wherein the inert gas comprises argon gas.

18. The method according to claim 11, wherein the striking face insert has a Young's Modulus of at least about 100 gigapascals (GPa).

19. The method according to claim 11, wherein the striking face insert has a Young's Modulus of about 100 GPa to about 115 GPa.

20. The method according to claim 11, wherein the single-step heat-treatment is performed under vacuum.

* * * * *